US010767570B2

(12) United States Patent
Vierkotten et al.

(10) Patent No.: US 10,767,570 B2
(45) Date of Patent: Sep. 8, 2020

(54) REGULATING DEVICE FOR AN INTERNAL COMBUSTION ENGINE

(71) Applicants: PIERBURG GMBH, Neuss (DE); FORD-WERKE GMBH, Cologne (DE)

(72) Inventors: Dirk Vierkotten, Much (DE); Maximilian Flender, Duesseldorf (DE); Christian Vigild, Aldenhoven (DE); Andreas Kuske, CM Geulle (NL); Franz Arnd Sommerhoff, Aachen (DE); Joerg Kemmerling, Monschau (DE); Helmut Kindl, Aachen (DE); Vanco Smiljanovski, Bedburg (DE); Hanno Friederichs, Aachen (DE)

(73) Assignees: PIERBURG GMBH, Neuss (DE); FORD-WERKE GMBH, Cologne (DE)

( * ) Notice: Subject to any disclaimer, the term of this patent is extended or adjusted under 35 U.S.C. 154(b) by 101 days.

(21) Appl. No.: 16/060,421

(22) PCT Filed: Nov. 14, 2016

(86) PCT No.: PCT/EP2016/077571
§ 371 (c)(1),
(2) Date: Jun. 8, 2018

(87) PCT Pub. No.: WO2017/097540
PCT Pub. Date: Jun. 15, 2017

(65) Prior Publication Data

US 2019/0003401 A1 Jan. 3, 2019

(30) Foreign Application Priority Data

Dec. 11, 2015 (DE) ..... 10 2015 121 616

(51) Int. Cl.
*F02D 9/10* (2006.01)
*F02M 26/50* (2016.01)
(Continued)

(52) U.S. Cl.
CPC ..... *F02D 9/101* (2013.01); *F02D 9/1015* (2013.01); *F02M 26/21* (2016.02); *F02M 26/50* (2016.02);
(Continued)

(58) Field of Classification Search
CPC ..... F02D 9/101; F02D 9/1015; F02D 2009/0276; F02M 26/21; F02M 26/70; F02M 26/64; F02M 26/50
(Continued)

(56) References Cited

U.S. PATENT DOCUMENTS

2003/0042448 A1* 3/2003 Conley ..... F02D 9/1015 251/118
2007/0102661 A1 5/2007 Isogai et al.
(Continued)

FOREIGN PATENT DOCUMENTS

DE 196 49 713 A1 6/1998
DE 102 40 762 A1 4/2003
(Continued)

*Primary Examiner* — Joseph J Dallo
*Assistant Examiner* — Scott A Reinbold
(74) *Attorney, Agent, or Firm* — Norman B. Thot

(57) ABSTRACT

A regulating device for an internal combustion engine includes a housing in which is formed an exhaust gas recirculation pipe which opens into an intake pipe, and a regulating element eccentrically mounted on a shaft. The regulating element includes a first surface, a second surface, and guide ribs arranged on the second surface so that an exhaust gas flow flows into the intake pipe when the exhaust gas recirculation pipe is opened. In a first end position of the regulating element, where the intake pipe is at throttled
(Continued)

upstream of an opening of the exhaust gas recirculation pipe, a normal vector of the first surface points to an upstream side of the intake pipe. In a second end position of the regulating element, where the exhaust gas recirculation pipe is closed, a normal vector of the second surface points to the exhaust gas recirculation pipe.

14 Claims, 2 Drawing Sheets

(51) Int. Cl.

| | |
|---|---|
| ***F02M 26/64*** | (2016.01) |
| ***F02M 26/70*** | (2016.01) |
| ***F02M 26/21*** | (2016.01) |
| ***F02D 9/02*** | (2006.01) |

(52) U.S. Cl.
CPC ..... *F02M 26/64* (2016.02); *F02M 26/70* (2016.02); *F02D 2009/0276* (2013.01)

(58) Field of Classification Search
USPC ..... 123/568.17
See application file for complete search history.

(56) References Cited

U.S. PATENT DOCUMENTS

| | | | | |
|---|---|---|---|---|
| 2009/0283076 | A1 | 11/2009 | Aoki et al. | |
| 2015/0027420 | A1* | 1/2015 | Antoni | F02M 35/10222 123/568.21 |
| 2015/0198119 | A1* | 7/2015 | Kuske | F02M 26/71 60/605.2 |

FOREIGN PATENT DOCUMENTS

| | | | |
|---|---|---|---|
| DE | 10 2006 051 987 | B4 | 8/2013 |
| DE | 10 2012 101 851 | B4 | 6/2014 |
| DE | 10 2013 223 053 | A1 | 5/2015 |
| DE | 10 2014 200 699 | A1 | 7/2015 |
| EP | 1 408 263 | A1 | 4/2004 |
| JP | 2001-98959 | A | 4/2001 |

* cited by examiner

REGULATING DEVICE FOR AN INTERNAL COMBUSTION ENGINE

CROSS REFERENCE TO PRIOR APPLICATIONS

This application is a U.S. National Phase application under 35 U.S.C. § 371 of International Application No. PCT/EP2016/077571, filed on Nov. 14, 2016 and which claims benefit to German Patent Application No. 10 2015 121 616.7, filed on Dec. 11, 2015. The International Application was published in German on Jun. 15, 2017 as WO 2017/097540 A1 under PCT Article 21(2).

FIELD

The present invention relates to a regulating device for an internal combustion engine having an intake pipe, an exhaust gas recirculation pipe that opens into the intake pipe, a housing in which the intake pipe and the exhaust gas recirculation pipe are formed, a shaft acting as an axis of rotation on which a regulating element is eccentrically mounted and which is arranged perpendicularly to the center lines of the intake pipe and the exhaust gas recirculation pipe, wherein, in a first end position, in which the intake pipe is at least throttled upstream of an opening of the exhaust gas recirculation pipe, a normal vector of a first surface of the regulating element points to the upstream side of the intake pipe, and, in a second position, in which the exhaust gas recirculation pipe is closed, a normal vector of a second surface of the regulating element points to the exhaust gas recirculation pipe.

BACKGROUND

Such regulating devices are used in internal combustion engines to regulate the gas flow to be introduced into a cylinder of an internal combustion engine with regard to its composition of recirculated exhaust gas quantities or air quantities freshly taken in. Different mixing ratios are set for reaching minimum exhaust gas values and maximum performance values depending on the operating condition of the internal combustion engine.

For regulating purposes, either two separate valves can be used, wherein a total quantity regulation via the two valves is possible, or these regulating valves comprise two valve elements which are actuated via a common actuating device so that only the mixture is changed. This configuration is in particular used in the case of turbocharged engines where the total quantity taken in can be regulated via the performance of the compressor. It is also known to use only one regulating element which cooperates with the two pipes instead of two regulating elements in order to be able to realize an even smaller configuration of the regulating device. In the case of these configurations, the exhaust gas recirculation pipe usually opens into the air intake pipe immediately downstream of the damper acting as a throttle valve. At the desired increase of the exhaust gas recirculation rate, the throttle damper is closed to the same extent to which the exhaust gas recirculation valve is opened, which results in an increase of the pressure gradient in the exhaust gas recirculation pipe besides the increase of the free cross-section of the exhaust gas recirculation pipe, whereby the fraction of the exhaust gas as compared with the air quantity taken in is increased.

Such an arrangement is described, for example, in DE 10 2012 101 851 B4 where two dampers arranged in parallel are actuated via a common rotating shaft so that, when the two dampers are rotated, the first damper is removed from the valve seat of the air intake pipe, while the second damper approaches the valve seat of the exhaust gas recirculation pipe, which is arranged perpendicularly to the valve seat of the air intake pipe, until the air intake pipe is fully opened and the exhaust gas recirculation pipe is fully closed. The valve seats for both for the second damper governing the exhaust gas recirculation pipe and for the first damper governing the air intake pipe are configured as stoppers against which the dampers fully rest in their position for closing the respective pipe. The rotating shaft is arranged at a housing wall between the opening of the exhaust gas recirculation pipe and the valve seat in the air intake pipe so that the flow is not affected by the shaft. A swirl generator is additionally arranged in the area of the opening of the exhaust gas recirculation pipe via which a swirl is impressed to the exhaust gas flow for improving mixing with the air flow.

US 2009/0283076 A1 additionally describes a damper that is arranged in an intake pipe and inside of which a pipe is formed through which exhaust gas flows that is introduced into the air flow at the damper end opposite to the shaft. While a thorough mixing of the two gas flows is attained due to this arrangement, the manufacture of the damper is laborious and the connection of the exhaust gas recirculation pipe to the inside of the damper cannot be realized in a leak-free manner. Regulation of the recirculated exhaust gas flow is not possible when this damper is used.

DE 10 2006 051 987 B4 describes a centrically mounted throttle damper on whose surface a plurality of ribs extending perpendicularly to the damper shaft are formed which serve for straightening the gas flow.

Although a good regulation of the exhaust gas recirculation system is attained with these known arrangements with costs and components being minimized, it has turned out that in particular in low-pressure exhaust gas recirculation systems, the turbulences occurring during mixing of the exhaust gas flow with the air flow affect the performance of the downstream compressor of the turbocharger or an electric compressor. Problems due to condensation may also arise if the wet exhaust gas flow is immediately directed into the cold air flow or to cold pipe walls. These condensates occurring in the gas flow may also cause damage to the compressor.

SUMMARY

An aspect of the present invention is to provide a regulating device for an internal combustion engine via which, with the air flow and the exhaust gas flow being adequately regulated compared to known configurations, an increased performance of a downstream compressor can be attained and damage due to condensation reliably avoided.

In an embodiment, the present invention provides a regulating device for an internal combustion engine which includes an intake pipe, an exhaust gas recirculation pipe configured to open into the intake pipe, a housing configured to have the intake pipe and the exhaust gas recirculation pipe be formed therein, a shaft configured to act as an axis of rotation, and a regulating element eccentrically mounted on the shaft. The shaft is arranged perpendicular to a center line of the intake pipe and to a center line of the exhaust gas recirculation pipe. The regulating element comprises a first surface, a second surface, and guide ribs arranged on the second surface. In a first end position of the regulating element, in which the intake pipe is at least throttled upstream of an opening of the exhaust gas recirculation pipe, a normal vector of the first surface points to an upstream side of the intake pipe. In a second end position of the regulating element, in which the exhaust gas recirculation pipe is closed, a normal vector of the second surface points to the exhaust gas recirculation pipe. The guide ribs are arranged on the second surface of the regulating element so that an exhaust gas flow flows into the intake pipe when the exhaust gas recirculation pipe is opened.

BRIEF DESCRIPTION OF THE DRAWINGS

The present invention is described in greater detail below on the basis of embodiments and of the drawings in which.

DETAILED DESCRIPTION

Figure 1:
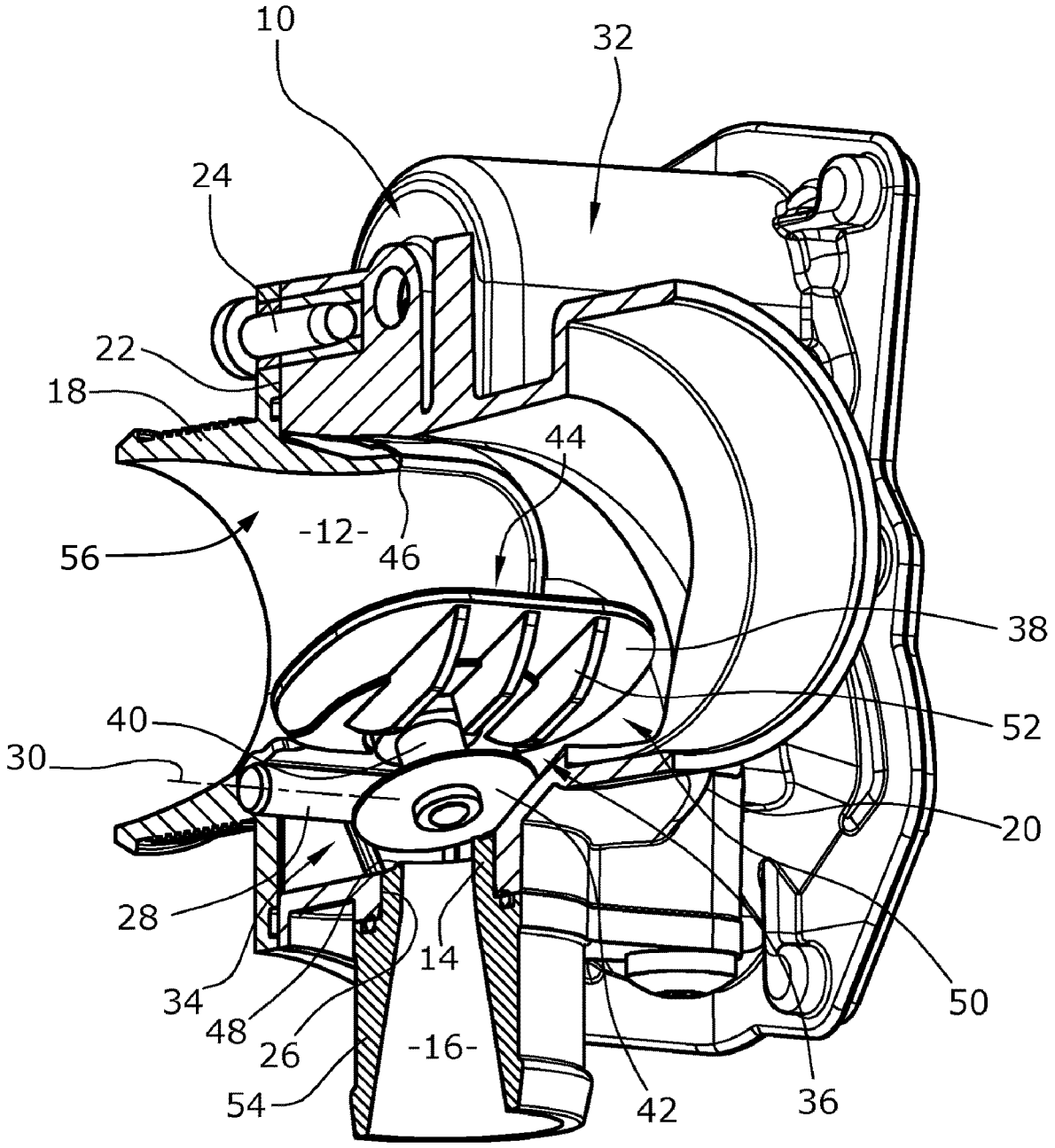
FIG. 1 shows a cross-sectional perspective view of a regulating device according to the present invention.

The recirculated exhaust gas flow can be controlledly directed into the intake pipe due to the fact that guide ribs are formed on the second surface along which exhaust gas flows into the intake pipe when the exhaust gas recirculation pipe is opened. Depending on the configuration and arrangement of the guide ribs, both condensation of the water in the exhaust gas can be avoided and a reduced output of the compressor due to a poor approach flow to the impeller and the occurring flow resistances caused by occurring turbulences can be prevented.

In an embodiment of the present invention, a first valve seat can, for example, be formed in the intake pipe against which the first surface of the regulating element rests in its first end position. An almost leak-free closure of the intake pipe is attained due to such an axial resting of the surface against the valve seat.

In an embodiment of the present invention, a second valve seat can, for example, be formed at the opening of the exhaust gas recirculation pipe against which a guide-rib-free area of the second surface of the regulating element rests in its second end position. The exhaust gas recirculation pipe can thus also be closed in an excellently sealed manner despite the guide ribs by using an area where no guide ribs are formed for the surface to axially rest against the valve seat.

In an embodiment of the present invention, the regulating element can, for example, comprise a damper which is eccentrically fastened to the shaft and which has the first surface and the second surface, and a coupling member which extends from the second surface and at which a closing member is formed that cooperates with the second valve seat, wherein the guide ribs extend from the second surface maximally up to the closing member.

The guide ribs can, for example, extend in parallel to each other along the second surface, whereby the exhaust gas flow is straightened, which leads to smaller pressure losses and allows the air flow to be controlledly aligned.

In an embodiment of the present invention, the guide ribs can, for example, extend perpendicularly to the axis of rotation of the regulating element. The exhaust gas flow is thus controlledly introduced in a straight manner into the air flow with low pressure losses occurring. A mixed gas flow can thus be introduced in a parallel and straight manner into a downstream compressor inlet, thereby increasing its efficiency.

It is alternatively possible that the guide ribs extend so as to be positioned at a fixed angle to the axis of rotation of the regulating element. The air flow in such a configuration can be forced to assume an angle to the main flow direction of the air, whereby a spiral flow can be produced at the inlet of the compressor for improving the performance.

An even stronger spiral flow with a reduced pressure loss is attained when the guide ribs, with an increasing distance to the axis of rotation, have an increasing inclination towards a normal to the axis of rotation.

In an embodiment of the present invention, the guide ribs can for example, be formed to be inclined towards each other in the direction of extension from the axis of rotation to the end distal to the axis of rotation. This means that the guide ribs are arranged like an open fan whose narrow end is located on the side of the damper remote from the shaft. The air flow is thereby concentrated and can be controlledly directed, for example, to the areas remote from the wall whereby, in the case of cold pipe walls, the condensation of water from the exhaust gas can be reduced, whereby the service life of the compressor is increased.

In an embodiment of the present invention, the second surface can, for example, have a curved configuration. Such a curvature also serves to direct the air flow into a desired area. A convex configuration thus leads to an introduction into the air flow, while a concave configuration of the curvature leads, for example, to an introduction into the flow shadow of the damper without any thorough mixing with the air flow. The curvature is accordingly also used to direct the air flow into desired areas of the pipe with the pressure loss being as small as possible.

In an embodiment of the present invention, the guide ribs can, for example, be formed so that the exhaust gas flow is adapted to be introduced into a defined area of the intake pipe. This may depend on the configuration and the downstream pipe routing. Depending on the type of internal combustion engine, either a thorough mixing, a laminar flow, a straight or swirl flows may be desired. A corresponding position of the guide ribs can be provided to improve the engine performance depending on the required type of flow.

In an embodiment of the present invention, a plane spanned by the first valve seat can, for example, include an angle of 70° to 80° to a plane spanned by the second valve seat. Such a smaller setting angle results in air and exhaust gas flows across the overall setting area also being varied when the damper is rotated. In this setting area, the slope of the control curve thus remains essentially unchanged.

In an embodiment of the present invention, the first valve seat can, for example, have a smaller circumference than the section of the intake pipe downstream of the first valve seat, and the regulating element, in its second end position for closing the exhaust gas recirculation pipe, can, for example, be inserted into a recess in the intake pipe, which is arranged in the flow shadow of the upstream section of the intake pipe. In the case of an open intake pipe, this means that no flow resistance attributable to the damper exists so that the compressor is supplied with a larger air flow. The pipe is also essentially made longer by the damper resting against it so that a production of an eddy behind the valve seat, which would also lead to flow losses, is prevented.

A regulating device is thus provided via which both the air mass flow in the intake pipe and the exhaust gas mass flow of the exhaust gas recirculation circuit are adapted to be regulated, wherein, at the same time, the performance of a downstream compressor for charging an internal combustion engine is optimized by an improved conduction of the flow. The conduction of the flow can be conformed by the guide ribs to the respective requirements of the internal combustion engine and/or to the existing required inflow conditions of the compressor used. A condensation of water vapor carried by the exhaust gas damage to the compressor and in particular to its rib assembly is accordingly prevented.

An exemplary embodiment of a regulating device according to the present invention is illustrated in the drawings and is described below.

The regulating device according to the invention is composed of a housing 10 which delimits an intake pipe 12 and at which an opening 14 of an exhaust gas recirculation pipe 16 is formed. The intake pipe 12 essentially extends in a straight direction to an axial inlet (not shown in the drawings) of a compressor housing of a turbocharger, while the exhaust gas recirculation pipe 16 opens approximately perpendicularly to the intake pipe 12 into the latter.

The housing 10 is composed of a first essentially tubular intake housing 18 whose downstream end is of an inclined configuration and which includes an angle $\alpha$ of approximately 80° to a center line of the intake pipe 12. The downstream end of the intake housing 18 projects into a mixing housing 20 and/or is inserted into the mixing housing 20 until a flange 22 rests against the mixing housing 20 via which the intake housing 18 is fastened to the mixing housing 20 by screws 24.

The opening 14 of the exhaust gas recirculation pipe 16 laterally projects into a port 26 of the mixing housing 20 which is configured as a separate housing portion. The mixing housing 20 forms an extension of the intake pipe 12 which then, in turn, ends in the axial inlet of the compressor housing. In the mixing housing 20, a shaft 28 is mounted so that it can be rotated about an axis of rotation 30 and can be actuated via an actuator 32. The axis of rotation 30 of the shaft 28 is arranged perpendicularly to the center lines of the intake pipe 12 and the exhaust gas recirculation pipe 16 and is located between the opening 14 of the exhaust gas recirculation pipe 16 at the end of the exhaust gas recirculation pipe 16 downstream of the air flow and the axial end of the intake housing 18 on the side facing the exhaust gas recirculation pipe 16. The throughflow cross-section of the intake housing 18 is smaller than that of the mixing housing 20, wherein the intake housing 18 is fastened to the mixing housing 20 so that a recess 34 formed downstream of the opening 14 of the exhaust gas recirculation pipe 16 is arranged in the flow shadow of the air flow from the intake housing 18, in which recess the shaft 28 passes through the mixing housing 20.

A regulating element 36 is fastened to shaft 28 eccentrically arranged in the intake pipe 12, the regulating element 36 being composed of a damper 38 as well as a closing member 42 fastened to the first damper 38 via a coupling member 40. The damper 38 extends from the shaft 28 into the inside of the mixing housing 20 and governs the throughflow cross-section of the intake pipe 12. For this purpose, the first surface 44 of the damper 38 cooperates with the axial end of the intake housing 18 acting as a first valve seat 46 against which the first surface 44 of the damper 38 rests in a first end position in a state for closing the intake pipe 12 so that in this state a normal vector of the first surface 44 points to the upstream side of the intake pipe 12 and/or to the intake housing 18.

A bore is formed in the damper 38 in which the coupling member 40 is fastened to the damper 38. The coupling member 40 extends to the side opposite to the intake housing 18, perpendicularly to the damper 38, and its opposite end passes through the closing member 42 which, in turn, is fastened to the end of the coupling member 40. Due to this fastening of the closing member 42, the exhaust gas recirculation pipe 16 is closed when the shaft 28 is rotated into a second end position in which the closing member 42 rests against a second valve seat 48 formed at the end of the opening 14 of the exhaust gas recirculation pipe 16.

According to the present invention, a plurality of guide ribs 52 are formed on a second surface 50 opposite to the first surface 44 of the damper 38, the guide ribs 52 extending from the second surface 50 up to the closing member 42 so that the guide ribs 52 are arranged opposite to the opening 14 when the exhaust gas recirculation pipe 16 is closed, without extending into the opening 14. A normal vector of the second surface 50 points to the exhaust gas recirculation pipe 16 in this second end position. An exhaust gas flow is accordingly directed along the guide ribs 52 when the exhaust gas recirculation pipe 16 is opened.

In the first exemplary embodiment illustrated in FIG. 1, the guide ribs 52 extend in parallel to each other and perpendicularly to the shaft 28. The guide ribs 52 are either connected to the damper 38 via a substance-to-substance connection or are integrally formed therewith. If the regulating element 36 composed of the damper 38, the guide ribs 52, the closing member 42, and the coupling member 40 is in the position illustrated in FIG. 1, the exhaust gas flow, straightened with the air flow, is introduced into the latter so that a uniform and slow mixing takes place without any larger turbulences and, consequently, with a low pressure loss. This low flow resistance leads to a large mixed gas quantity being able to be supplied to the compressor via the compressor inlet, whereby the performance of the downstream internal combustion engine is increased.

It should be noted in this context that it is, of course, also possible to omit the additional coupling member 40 and the additional closing member 42 and to directly use the second surface 50 of the damper 38 to close the second valve seat 48. In the case of such a configuration, it is merely necessary not to provide the area resting against the second valve seat 48 with guide ribs 52 and to arrange the guide ribs 52 so that the rotational movement of the shaft 28 out of the end position, in which the exhaust gas recirculation pipe 16 is closed, is not affected by the guide ribs 52 abutting against pipe walls 54 of the exhaust gas recirculation pipe 16.

FIGS. 2-5 show various further advantageous embodiments of the guide ribs 52 whose shape and arrangement may vary depending on the configuration and size of the downstream compressor and the internal combustion engine as well as the field of use.

Figure 2:
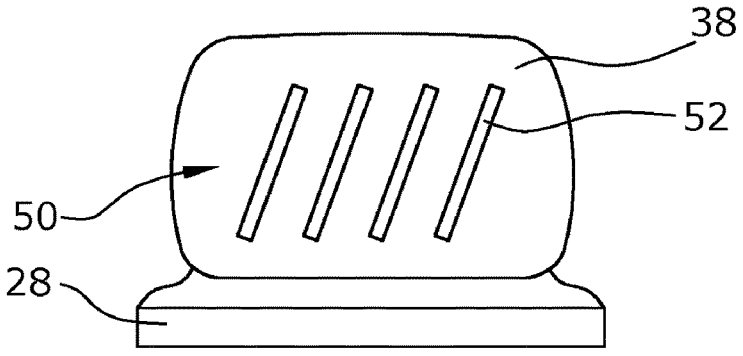
FIG. 2 schematically shows an embodiment of the guide ribs of a regulating device according to the present invention.

FIG. 2 thus shows guide ribs 52 on the second surface 50 of the damper 38 which are positioned at an angle of approximately 20° relative to a normal to the axis of rotation of the shaft 28. As a result, an exhaust gas flow is deflected to the side by the guide ribs 52 and a swirl in the mixed gas flow is produced when the exhaust gas flow enters the air flow. This results in a more rapid mixing of the two gas flows and usually leads to an increased performance of the compressor due to the swirl-like inflow.

Figure 3:
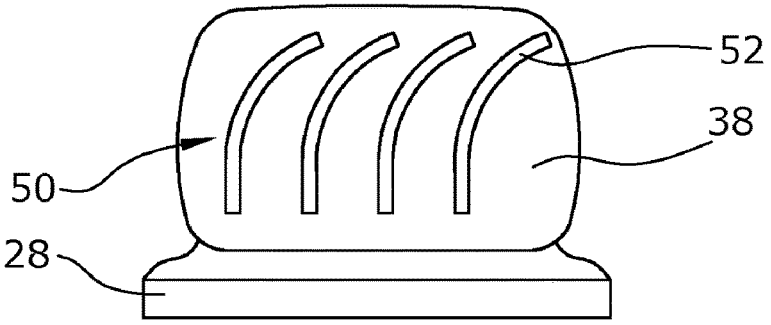
FIG. 3 schematically shows an embodiment of the guide ribs of a regulating device according to the present invention.

The embodiment shown in FIG. 3 also results in such an increased performance of the downstream compressor due to an impressed swirl, however, with a reduced flow resistance and thus an increased overall mixed gas flow. In this embodiment, the guide ribs 52 again extending in parallel have an arcuate configuration, wherein the inclination towards the normal to the axis of rotation of the shaft 28 also increases with an increasing distance to the shaft 28. Due to this gradual deflection of the exhaust gas flow as compared with the embodiment illustrated in FIG. 2, fewer turbulences occur and, as a consequence, the flow resistance is decreased.

Figure 4:
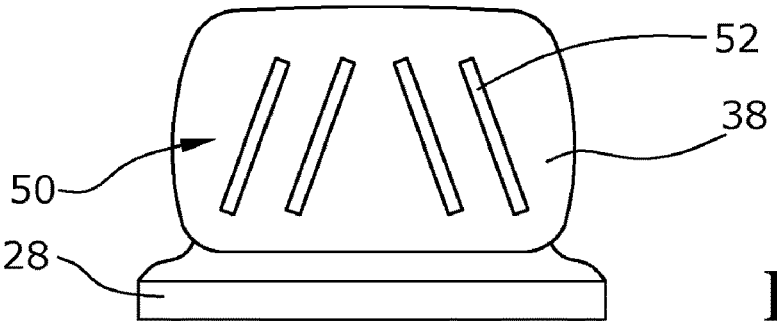
FIG. 4 schematically shows an embodiment of the guide ribs of a regulating device according to the present invention.

FIG. 4 shows another possible embodiment of the guide ribs 52 on the surface 50. The distance of these guide ribs 52 to each other decreases with an increasing distance to the shaft 28. This means that the guide ribs 52 are inclined towards one another. The exhaust gas flow is accordingly centrally concentrated in the illustrated embodiment. Any other concentration to a different place of the intake pipe 12 would be conceivable in such an embodiment, wherein the central introduction of the exhaust gas flow offers the advantage that the hot exhaust gas flow carrying water vapor is introduced into an area where it is not immediately directed to walls 56 of the intake pipe 12 which may be cold depending on ambient conditions. Any condensation of the water is accordingly considerably reduced, whereby, in turn, damage to the blades of the compressor is avoided.

Figure 5:
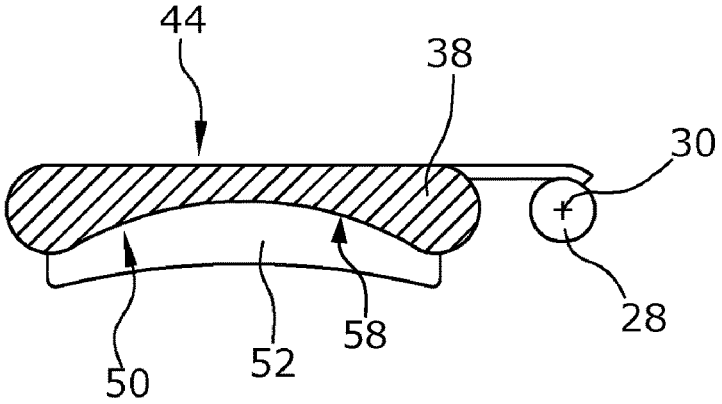
FIG. 5 schematically shows an embodiment of the guide ribs of a regulating device according to the present invention.

In the embodiment illustrated in FIG. 5, the guide ribs 52 are again formed perpendicularly to the axis of rotation 30, but they are located on a surface 58 which is concave as seen in a cross-sectional view, which leads to the exhaust gas flow not being immediately directed into the air flow, but a laminar flow instead being produced in the mixing housing 20, via which the exhaust gas flow can be prevented from cooling too rapidly due to mixing with a possibly cold air flow.

The described regulating device is thus suitable for a very exact proportioning of an exhaust gas mass flow into an air mass flow and for an exact regulation of the air mass flow using only one actuator, wherein the flows can be directed in almost any desired manner by using guide ribs on the second surface of the damper in order to optimize the performance of the internal combustion engine and/or the performance of a downstream compressor without having to use any further fittings. For this purpose, via a corresponding arrangement of the ribs, the exhaust gas flow can be straightened, concentrated, or a swirl may be applied to the exhaust gas flow. It can also either be kept away from the air flow or directly introduced into the air flow. Besides the degrees of mixture adapted to be influenced in this manner, flow resistances or condensation of the exhaust gas can be influenced.

It should be appreciated that the scope of protection of the present application is not limited to the described exemplary embodiments. Various versions of the position of the guide ribs as well as various shapes of the surfaces of the damper are also conceivable. As described above, it is also possible to configure the regulating device with or without an additional closing member. Reference should also be had to the appended claims.

What is claimed is:

1. A regulating device for an internal combustion engine, the regulating device comprising:

an intake pipe;

an exhaust gas recirculation pipe configured to open into the intake pipe;

a housing configured to have the intake pipe and the exhaust gas recirculation pipe be formed therein;

a shaft configured to act as an axis of rotation, the shaft being arranged perpendicular to a center line of the intake pipe and to a center line of the exhaust gas recirculation pipe; and a regulating element eccentrically mounted on the shaft, the regulating element comprising a first surface, a second surface, and guide ribs arranged on the second surface, wherein, in a first end position of the regulating element, in which the intake pipe is at least throttled upstream of an opening of the exhaust gas recirculation pipe, a normal vector of the first surface points to an upstream side of the intake pipe, in a second end position of the regulating element, in which the exhaust gas recirculation pipe is closed, a normal vector of the second surface points to the exhaust gas recirculation pipe, and the guide ribs are arranged on the second surface of the regulating element so that an exhaust gas flow flows into the intake pipe when the exhaust gas recirculation pipe is opened.

2. The regulating device as recited in claim 1, further comprising:

a first valve seat arranged in the intake pipe, wherein, the first surface of the regulating element is configured to rest against the first valve seat when in the first end position.

3. The regulating device as recited in claim 2, further comprising:

a second valve seat arranged at the opening of the exhaust gas recirculation pipe, wherein, a guide-rib-free area of the second surface of the regulating element is configured to rest against the second valve seat in the second end position.

4. The regulating device as recited in claim 3, wherein a plane spanned by the first valve seat comprises an angle of 70° to 80° to a plane spanned by the second valve seat.

5. The regulating device as recited in claim 3, wherein, the regulating element further comprises, a damper eccentrically fastened to the shaft, the damper comprising the first surface and the second surface, and a coupling element configured to extend from the second surface, the coupling element comprising a closing member formed thereon which is configured to cooperate with the second valve seat, and the guide ribs are configured to extend from the second surface maximally up to the closing member.

6. The regulating device as recited in claim 5, wherein the guide ribs are configured to extend in parallel to each other along the second surface.

7. The regulating device as recited in claim 6, wherein the guide ribs are configured to extend perpendicular to the axis of rotation.

8. The regulating device as recited in claim 6, wherein the guide ribs extend so that they are positioned at a fixed angle to the axis of rotation.

9. The regulating device as recited in claim 6, wherein the guide ribs, with an increasing distance to the axis of rotation, are arranged to have an increasing angle with respect to a vector which is perpendicular to the axis of rotation.

10. The regulating device as recited in claim 5, wherein the guide ribs are configured to be inclined towards each other in a direction of extension from the axis of rotation to an end distal to the axis of rotation.

11. The regulating device as recited in claim 2, wherein, the first valve seat comprises a circumference which is smaller than a circumference of a section of the intake pipe downstream of the first valve seat, the intake pipe comprises a recess arranged in a flow shadow of an upstream section of the intake pipe, and the regulating element, in the second end position in which it closes the exhaust gas recirculation pipe, is inserted into the recess in the intake pipe.

12. The regulating device as recited in claim 1, wherein the second surface comprises a curved configuration.

13. The regulating device as recited in claim 1, wherein the guide ribs are formed so that the exhaust gas flow is adapted to be introduced into a defined area of the intake pipe.

14. The regulating device as recited in claim 1, wherein, the second surface comprises a first half and a second half, the first half and the second half being defined by a line which bisects the second surface of the regulating element parallel to the axis of rotation of the shaft, and the guide ribs are arranged on each of the first half and on the second half.

* * * * *